US006142823A

United States Patent [19]

Ishibashi

[11] Patent Number: 6,142,823

[45] Date of Patent: Nov. 7, 2000

[54] ELECTRONIC COMPONENT CONNECTOR

[75] Inventor: Iwao Ishibashi, Tokyo, Japan

[73] Assignee: SMK Corporation, Japan

[21] Appl. No.: 09/388,599

[22] Filed: Sep. 2, 1999

[30] Foreign Application Priority Data

Sep. 8, 1998 [JP] Japan ..... 10-270546

[51] Int. Cl.[7] ..... H01R 3/00

[52] U.S. Cl. ..... 439/500

[58] Field of Search ..... 439/500, 356, 439/929, 626, 581, 68

[56] References Cited

U.S. PATENT DOCUMENTS

| | | | |
|---|---|---|---|
| 3,830,988 | 8/1974 | Mol et al. | 179/187 |
| 4,420,706 | 12/1983 | Siebold et al. | 310/324 |
| 4,965,483 | 10/1990 | Abe et al. | 310/324 |
| 5,021,701 | 6/1991 | Takahashi et al. | 310/345 |
| 5,805,423 | 9/1998 | Wever et al. | 361/760 |
| 5,830,007 | 11/1998 | Fry et al. | 439/500 |
| 5,889,873 | 3/1999 | Sasaki | 381/190 |

*Primary Examiner*—Khiem Nguyen
*Assistant Examiner*—Son V. Nguyen
*Attorney, Agent, or Firm*—Morrison Law Firm

[57] ABSTRACT

An electronic component connector has first and second connection sections disposed in an indentation in an insulating housing. The first connection section is annularly formed at a first radius at the bottom of the indentation. The second contact section is disposed at a second radius within the annulus of the first contact section. An electronic component has first and second contacts positioned at the first and second radius to electrically engage the first and second connection sections when the electronic component is contained in the indentation. Additional concentric annular connection sections formed at the bottom of the indentation allow for electrical connection to electronic components having additional contacts positioned to engage the additional annular connection sections when the electronic component is contained in the indentation. Such an electronic component connector allows for the insertion of the electronic component without regard to the rotational orientation of the electronic component relative to the insulating housing.

7 Claims, 5 Drawing Sheets

ELECTRONIC COMPONENT CONNECTOR

BACKGROUND OF THE INVENTION

The present invention relates to an electronic component connector. More particularly, the present invention relates to an electronic component connector for use in electrically connecting a terminal of an electronic component to a conducting section of a circuit board.

Referring to FIG. 8, an electronic component, such as a speaker 100 is directly mounted onto a circuit board 103. Speakers terminal 101 and 102 are electrically and mechanically inserted into respective through holes 104 in the circuit board 103. The speaker terminals 101 and 102 are soldered to an unillustrated conductive section on the reverse side of the circuit board 103.

Since the speaker terminals 101 and 102 must be inserted into the respective through holes 104, the speaker terminals 101 and 102 must be brought into alignment with the through holes 104. Connection of the speaker terminals 101 and 102 to the conductive section of the circuit board 103 is troublesome, thereby making automatic assembly of a speaker difficult.

OBJECTS AND SUMMARY OF THE INVENTION

It is an object of the present invention is to provide an electronic component connector which facilitates connection of an electronic component to a conductive section of a circuit board.

It is a further object of the invention to provide an electronic component connector which is suitable for automatic assembly of the electronic components.

Briefly stated, the present invention provides an electronic component connector has first and second connection sections disposed in an indentation in an insulating housing. The first connection section is annularly formed at a first radius at the bottom of the indentation. The second contact section is disposed at a second radius within the annulus of the first contact section. An electronic component has first and second contacts positioned at the first and second radius to electrically engage the first and second connection sections when the electronic component is contained in the indentation. Additional concentric annular connection sections formed at the bottom of the indentation allow for electrical connection to electronic components having additional contacts positioned to engage the additional annular connection sections when the electronic component is contained in the indentation. Such an electronic component connector allows for the insertion of the electronic component without regard to the rotational orientation of the electronic component relative to the insulating housing.

According to an embodiment of the invention, there is provided an electronic component connector comprising an insulating housing; an indentation in the insulating housing for storing an electronic component; a first connection section exposed on an inner bottom surface of the indentation; a second connection section exposed on an inner bottom surface of the indentation; a cover closeable over the electronic component in the indentation and effective for producing a downward force on the electronic component; the first connection section being an annulus having a first radius relative to a center of the indentation; the second connection section being disposed within the annulus at a second radius relative to the center; the electronic component having first and second resiliently urged contacts at a surface thereof facing a bottom of the indentation; the first contact being disposed, when the electronic component is contained in the indentation, at the first radius, whereby electrical contact is enabled with the first connection section; and the second contact being disposed, when the electronic component is contained in the indentation, at the second radius, whereby electrical contact is enabled with the second connection section, whereby installation of the electronic component in the indentation is independent of a rotational orientation of the electronic component with respect to the insulating housing.

Preferably, either the first connection section or the second connection section is circularly exposed in substantially the center of the inner bottom surface of the indentation. The remaining connection section is exposed such that the exposed portion thereof surrounds and is spaced away from the circularly-exposed connection section on the inner bottom surface of the indentation.

The above, and other objects, features and advantages of the present invention will become apparent from the following description read in conjunction with the accompanying drawings, in which like reference numerals designate the same elements.

DETAILED DESCRIPTION OF THE INVENTION

Figure 1:
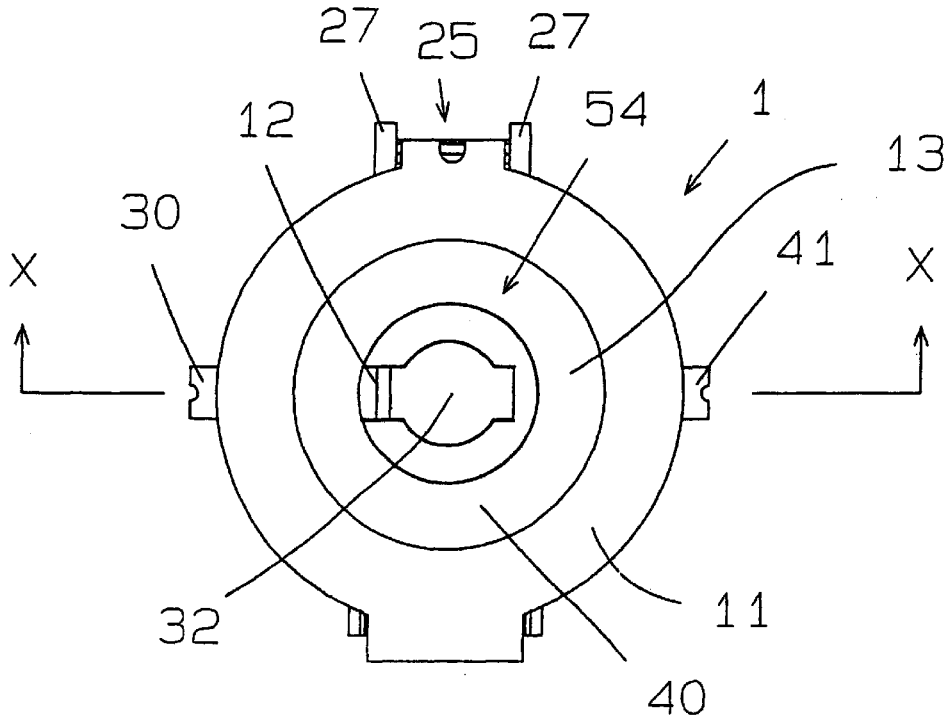
FIG. 1 is a plan view showing a connector according to the present invention.

Referring to FIGS. 1 through 5, an electronic component connector, shown generally at 1, includes a cover 11 attached to an insulating housing 10. The overall shape of the insulating housing 10 is circular. A circular indentation 20 accommodates an electronic component, such as a speaker 2. A stopper step 28 is formed around the internal circumferential wall surface of the indentation 20. When the cover 11 is placed on the insulating housing 10, the stopper step 28 receives the downward force exerted on the speaker 2 from the cover 11.

Figure 5:
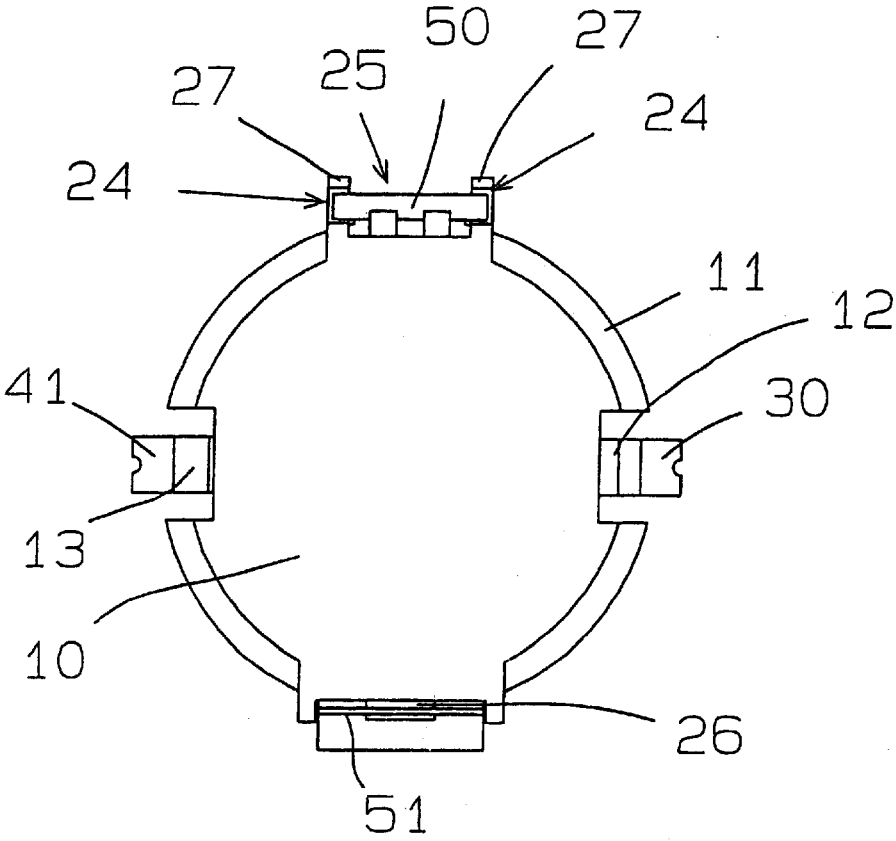
FIG. 5 is a bottom view showing the connector according to the present invention.

Referring to FIG. 5, an L-shaped pivot 27, on the side surface of the insulating housing 10 includes a notch 25 and grooves 24. A projection 26 projects outwardly from a position 180° opposite the pivot 27 along the circumference of the insulating housing 10.

A straight, thin piece of conductive metal is bent to form a first contact 12. A terminal section 30 is formed at one end of the first contact 12. The terminal section 30 is electrically connected to an unillustrated conductive section of a circuit board 3. A connection section 32, having a circular shape, is formed at the other end of the first contact 13. The connection section 32 is electrically connected to a first terminal of the speaker.

A second straight, thin piece of conductive metal is bent to form a second contact 13. A terminal section 41 is formed at one end of the second contact 13. The terminal section 41 is electrically connected to an unillustrated conductive section of a circuit board 3. An annular connection section 40 is formed at the other end of the second contact 13.

The first contact 12 and the second contact 13 are fixedly molded into a single unit together with the insulating housing 10. The connection section 32 is exposed substantially at the center of the inner bottom surface of the speaker housing indentation 20. The connection section 40 is set so as to become annularly exposed and spaced away from the connection section 32 in aconcentric manner. The connection sections 32 and 40 are flush with the inner bottom surface of the insulating housing 10.

The cover 11 has a circular shape. A circular hole 54 formed in the cover 11 serves as a first window. The circular hole 53 corresponds to the position of the indentation 20. A fulcrum section 50 is formed on the cover 11 to movably fit into the grooves 24. The fulcrum section 50 serves as a fulcrum when the cover 11 is pivotally moved relative to the insulating housing 10. An engagement section 51 is formed at a position 180° opposite the fulcrum section 50 along the circumference of the cover 11. A lock hole 52 is formed in the engagement section 51 to engage the projection 26, thereby locking the cover 11.

Figure 1A:
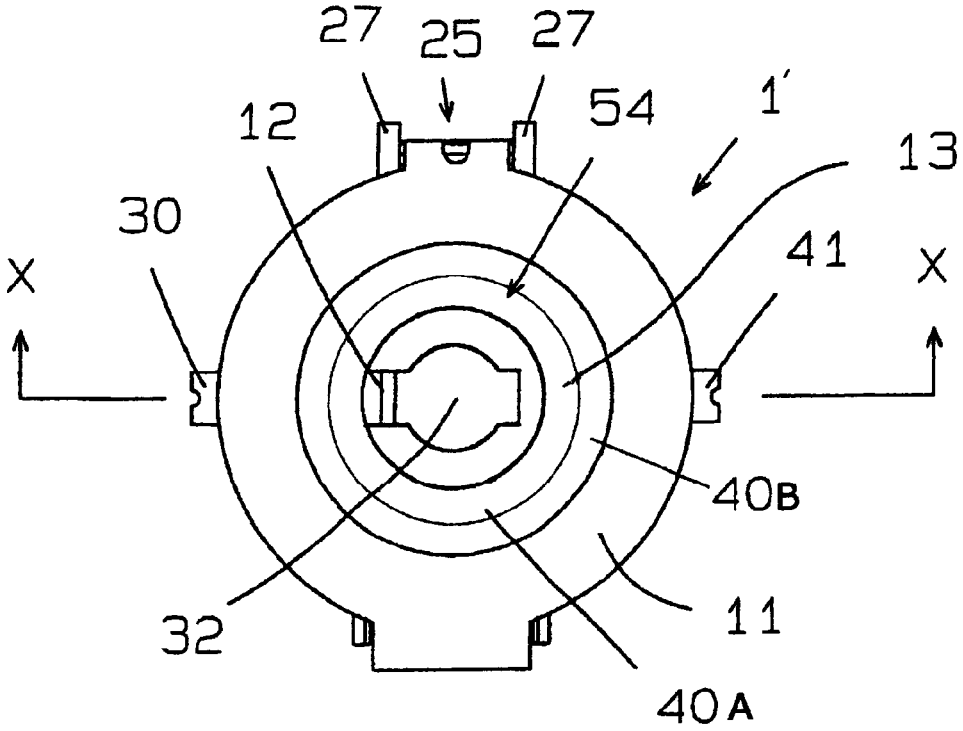
FIG. 1*a* is a plan view showing a connector according to an embodiment of the present invention.
Figure 3:
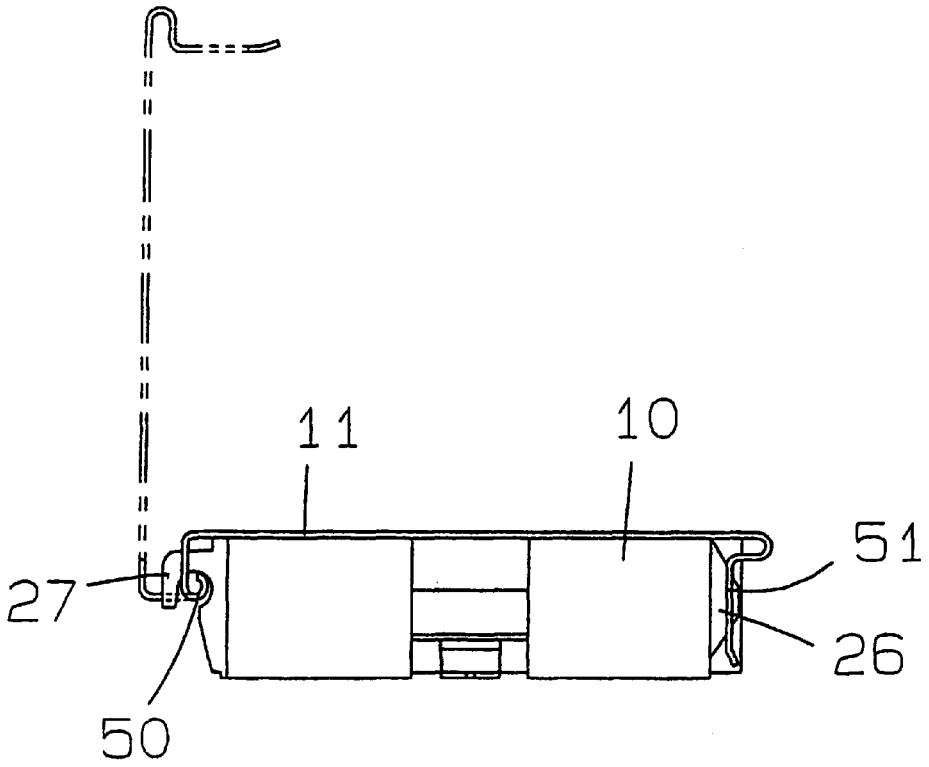
FIG. 3 is a front view showing the connector.
Figure 4:
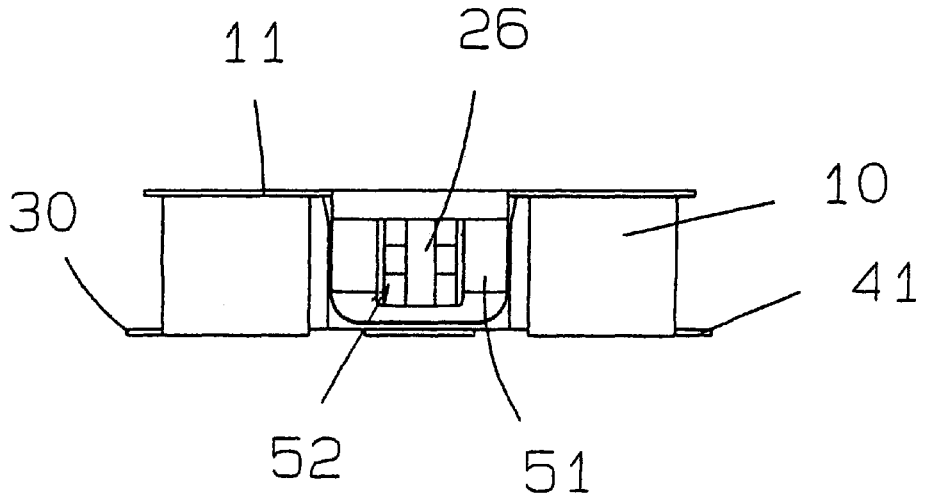
FIG. 4 is a side view showing the connector according to the present invention.

Referring to FIG. 1*a*, the connector 1' provides for a first connection section 32, a second connection section 40A, and a third connection 40B. Each of the connection sections are annularly exposed and spaced away from the other connection sections in a concentric manner. The connection sections 32, 40A, and 40B are flush with the inner bottom surface of the insulating housing 10.

Figure 6:
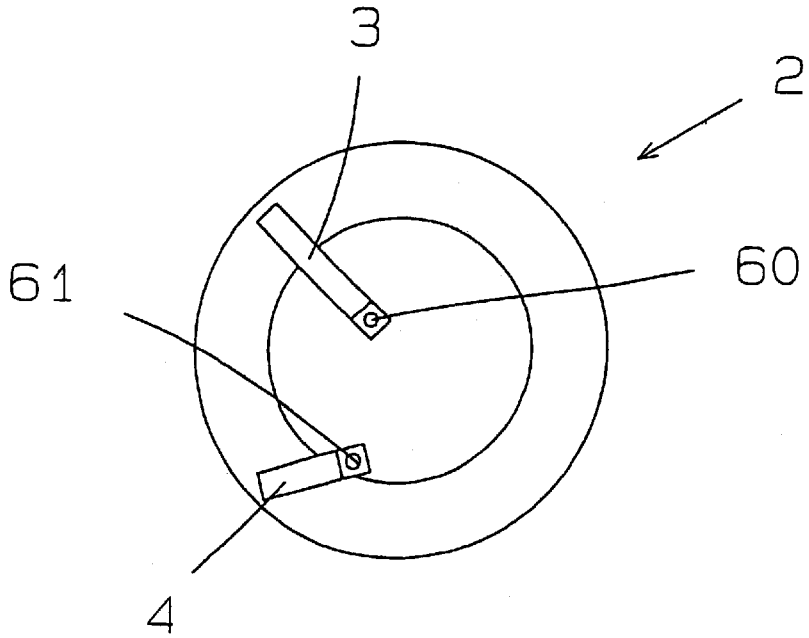
FIG. 6 is a bottom view showing a speaker to which reference will be made in explaining the present invention.
Figure 7:
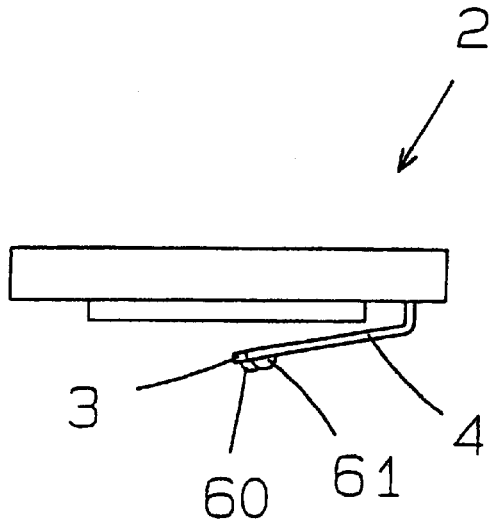
FIG. 7 is a front view showing the speaker of FIG. 6.
Figure 8:
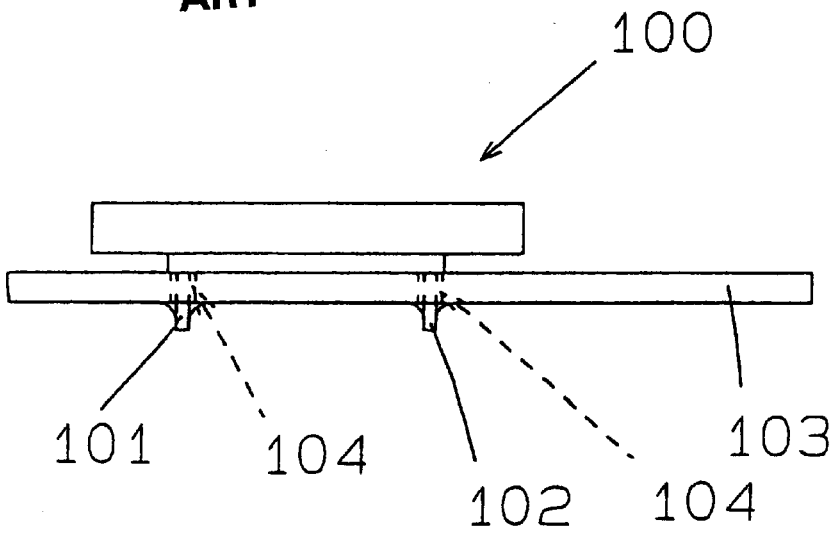
FIG. 8 PRIOR ART
FIG. 8 is a front view showing a conventional speaker mounted on a circuit board according to the prior art.

Referring to FIGS. 6 through 8, the speaker 2 has a circular shape. Speaker terminals 3 and 4, projecting from the bottom surface of the speaker 2, are bent into an L-shape. A contact 60 is formed at the leading end of the speaker terminal 3. The contact 60 is connected to the first contact 12. A contact 61 is formed at the leading end of the speaker terminal 4. The contact 61 is connected to the second contact 13. The contact 60 corresponds to the concentric position of the contact section 32 relative to the center of the speaker 2. The contact 61 corresponds to the concentric position of the contact section 40 relative to the center of the speaker 2. The speaker terminals 3 and 4 are elastically deformable in the vertical direction of FIG. 7.

Example 1—A Portable Cellular Phone

In the following example, a speaker of a portable cellular phone is attached to the connector 1.

The connector 1 is mounted in a predetermined position on the circuit board 3 by applying suction to the inner bottom surface of the indentation 20 using an unillustrated automatic machine. The terminal sections 30 and 41 are soldered to an unillustrated conductive section of the circuit board 3.

Next, the speaker 2 is dropped into the indentation 20 without concern for the rotational orientation of the speaker 2. The contact 60 is positioned at a radius which corresponds to the concentric position of the contact section 32 relative to the center of the speaker 2. The contact 61 is positioned at a radius which correspond to the concentric position of the contact section 40 relative to the center of the speaker 2. The connection section 32 is circularly exposed in substantially the center of the inner bottom surface of the insulating housing 10. The connection section 40 is annularly exposed and concentrically spaced away from the connection section 32. This allows connection to be made with the speaker 2 without concern for rotational orientation.

The fulcrum 50 of the cover 11 is movably fitted in the grooves 24. The cover 11 pivots in the clockwise direction of FIG. 3 about the fulcrum section 50 between the positions denoted by a solid line and a two-dot chain line shown in FIG. 3. As a result, the lock hole 52 and the projection 26 engage such that the cover 11 covers the indentation 20, fixing the cover 11 on the insulating housing 10. In the assembled condition, the cover 11 slightly presses downward on the speaker 2, reliably bringing the speaker terminals 3 and 4 into pressing contact with the first contact 12 and the second contact 13. At this time, the outer periphery of the speaker 2 contacts the stopper step 28, thereby preventing deformation of the speaker terminals 3 and 4, which would otherwise be caused if the speaker 2 were pressed downwardly with greater force than necessary. The speaker 2 is held in a position substantially parallel with the inner bottom surface of the indentation 20 of the speaker 2. This stabilizes the connection between the speaker terminal 3 and the connection section 32 as well as the connection between the speaker terminal 4 and the connection section 40.

Figure 2:
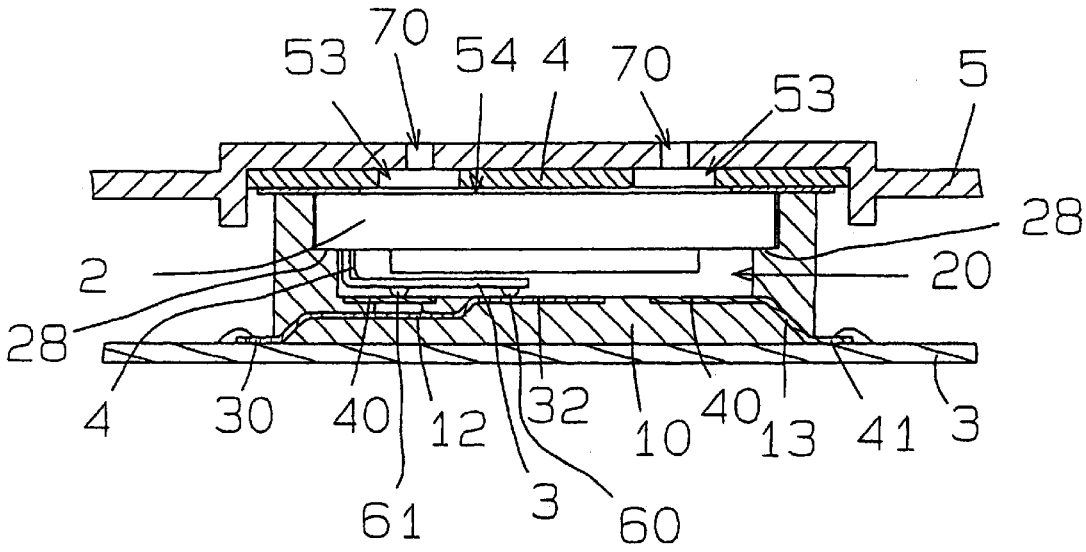
FIG. 2 is a cross-sectional view taken along line X—X in FIG. 1.

Referring to FIG. 2, the circuit board 3 is mounted on a housing 5 of a portable cellular telephone (not shown). The connector 1 is attached to the electronic component with shock a absorbing material 4 being interposed between the connector 1 and the housing 5. A window 53 is formed in the shock absorbing material 4, and a window 70 is formed in the housing 5 so as to correspond to the position of the window 53.

As a result, sound originating from the speaker 2 travels to the outside of the electronic component through the window 53 formed in the shock absorbing material 4 and the window 70 in the housing 5.

The electronic component to which the connector 1 is attached is not limited to a portable cellular phone but can also be applied to any types of electronic component, such as a portable radio or a portable CD player.

In the connector 1 described above, the connection section 32 of the first contact 12 and the connection section 40 of the second contact 13 are exposed on the inner bottom surface of the indentation 20 in a concentric manner. The connection section 32 is circularly exposed on the inner bottom surface of the indentation 20. The connection section 40 is annularly exposed around the connection section 32 on the inner bottom surface of the indentation 20. The contact 60 is formed to correspond to the concentric position of the contact section 32 relative to the center of the speaker 2. The contact 61 is formed to correspond to the concentric position of the contact section 40 relative to the center of the speaker 2. Consequently, connection of the speaker 2 to the indentation 20 does not require consideration of directionality. The speaker terminals 3 and 4 are easily connected to the conductive section of the circuit board 3 to form an electronic component connector according to the present invention which is suited for automated assembly.

Since the cover 11 slightly presses the speaker downwardly, the first and second contacts 12 and 13 are reliably pressed into pressing contact to make electrical connection to the respective speaker terminals 3 and 4.

Since the connection section 32 is circularly exposed in substantially the center of the inner bottom surface of the indentation 20, the connection section 32 is reliably connected to the contact 60 even if there is a slight positional deviation from the position of the contact 60.

Since the connector 1 is mounted on the housing 5 of the electronic component with the shock absorbing material 4 interposed between the housing 5 and the cover 11, vibration originating from the speaker 2 is absorbed by the shock absorbing material. This prevents sound attenuation, which would otherwise be caused by resonance.

Since the speaker 2 is covered with the inner circumferential wall and the inner bottom surface of the indentation 20, the sound originating from the speaker 2 is prevented from escaping in the rearward direction, thus ensuring transmission of sound with no accompanying transmission loss.

The present invention is not limited to the foregoing embodiment, and various modifications of the embodiment are conceivable without exceeding the technical scope of the present invention. For example, according to the present invention, the connection section 32 is exposed in substantially the center of the inner bottom surface of the indentation 20, and the connection section 40 is annularly exposed around the connection section 32. However, the connection section 40 may be exposed in substantially the center of the indentation 20, and the connection section 32 may be annularly exposed around the connection section 40. Further, although the connection section 32 is exposed in substantially the center of the inner bottom surface of the indentation 20, there is no necessity for setting the connection section 32 exposed in substantially the center of the inner bottom surface. The connection section 32 may be annularly exposed in any position on the inner bottom surface of the indentation 20, so long as the connection section 32 corresponds to the radial positions of the contacts 60 or 61 of the speaker 2. Furthermore, although in the present embodiment the connection section 32 is formed into a circular shape and the connection section 40 is formed into an annular shape beforehand, there is no need to form them in advance. At the time of integrally molding the first and second contacts 12 and 13 together with the insulating housing 10, the periphery of the first contact may be covered so as to become circularly exposed or the periphery of the second contact may be covered so as to become annularly exposed. Although the electronic component connector according to the present invention employs only two contacts, i.e., the first contact 12 and the second contact 13, the number of contacts is not necessarily limited to two. The number of contacts can be arbitrarily set to any number, e.g., three or four. In such a case, three or four connection sections may be annularly exposed on the bottom surface of the indentation 20 in a concentric manner. Although the connector 1 is attached to the housing 5 of the electronic device with the shock absorbing material 4 interposed in between, there is no necessity for interposing the shock absorbing material 4 between the connector 1 and the housing 5. The electronic component connector according to the present invention is applicable not solely to attachment of electronic component which issues sound, such as a speaker, but is also applicable to any type of electronic components so long as a circular electronic component is connected to the circuit board.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electronic component connector comprising:

an insulating housing;

an indentation in said insulating housing for receiving an electronic component;

a first connection section exposed on said inner bottom surface of said indentation;

a second connection section exposed on said inner bottom surface of said indentation;

a cover closeable over said electronic component in said indentation and effective for producing a downward force on said electronic component;

said second connection section being an annulus having a second radius relative to a center of said indentation;

said first connection section being disposed within said annulus at a first radius relative to said center;

said electronic component having first and second resiliently urged contacts at a surface thereof facing a bottom of said indentation;

said first contact being disposed, when said electronic component is contained in said indentation, at said first radius, whereby electrical contact is enabled with said first connection section; and said second contact being disposed, when said electronic component is contained in said indentation, at said second radius, whereby electrical contact is enabled with said second connection section, whereby installation of said electronic component in said indentation is independent of a rotational orientation of said electronic component with respect to said insulating housing.

2. The electronic component connector according in claim 1, wherein:

said first connection section is disposed in substantially the center of an inner bottom surface of said indentation; and said second connection section is spaced apart from and concentric with said first connection section.

3. The electronic component connector according to claim 1 further comprising:

at least a third connection section;

said third connection section being an annulus having a third radius greater than said first radius, and disposed concentric with said first connection section, and spaced outward therefrom;

said electronic component having at least a third contact point;

said third contact being disposed, when said electronic component is contained in said indentation, at said third radius, whereby electrical contact is enabled with said third connection section, whereby installation of said electronic component in said indentation is independent of a rotational orientation of said electronic component with respect to said insulating housing.

4. The electronic component connector according to claim 1 further comprising a housing containing said electronic component connector.

5. The electronic component connector according to claim 1 wherein said cover includes a shock absorbing material on said cover contacting said electronic component in said housing to produce a downward force on said electronic component.

6. The electronic component connector according to claim 1 wherein said electronic component is a speaker.

7. The electronic component connector according to claim 6 wherein said speaker is attached to a circuit board of a portable cellular telephone.

* * * * *